US009291421B1

(12) United States Patent
Kempf

(10) Patent No.: US 9,291,421 B1
(45) Date of Patent: Mar. 22, 2016

(54) ASSAULT RIFLE STYLE MAINFRAME BARREL FOR A CROSSBOW

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 5 days.

(21) Appl. No.: 14/554,290

(22) Filed: Nov. 26, 2014

(51) Int. Cl.
*F41B 5/12* (2006.01)
*F41B 5/14* (2006.01)
*F41C 23/00* (2006.01)
*F41C 23/14* (2006.01)

(52) U.S. Cl.
CPC . *F41B 5/12* (2013.01); *F41B 5/123* (2013.01); *F41B 5/14* (2013.01); *F41C 23/14* (2013.01)

(58) Field of Classification Search
CPC ..... F41B 5/12; F41B 5/123; F41B 5/14; F41C 23/14
USPC ..... 124/25, 86, 88; 42/73
See application file for complete search history.

(56) References Cited

U.S. PATENT DOCUMENTS 4,169,456 A * 10/1979 Van House ..... F41B 5/12 124/25
4,917,071 A * 4/1990 Bozek ..... F41B 5/12 124/24.1
5,025,771 A * 6/1991 Hanson ..... F41B 5/1469 124/25
5,119,797 A * 6/1992 Anderson ..... F41B 5/143 124/24.1
5,209,215 A * 5/1993 Morrison ..... F41B 5/12 124/22
5,522,373 A * 6/1996 Barnett ..... F41B 5/12 124/23.1
5,553,596 A * 9/1996 Bednar ..... F41B 5/1426 124/25
6,839,998 B1 * 1/2005 Armstrong ..... F41C 23/00 42/71.01
6,925,744 B2 * 8/2005 Kincel ..... F41C 23/22 42/71.01
7,748,370 B1 * 7/2010 Choma ..... F41B 5/12 124/25
7,810,480 B2 * 10/2010 Shepley et al. ..... F41A 11/02 124/25
8,033,275 B2 * 10/2011 Bednar et al. ..... F41B 5/123 124/25
8,127,483 B2 * 3/2012 Kincel ..... F41C 23/04 42/71.01
8,341,868 B2 * 1/2013 Zusman ..... F41C 23/22 42/73
8,387,603 B2 * 3/2013 Darlington ..... F41B 5/10 124/23.1
8,651,094 B2 * 2/2014 Matasic et al. ..... F41B 5/12 124/23.1
8,800,540 B1 * 8/2014 Choma ..... F41B 5/12 124/25
8,813,735 B2 * 8/2014 Biafore, Jr. et al. ..... F41B 5/12 124/25

(Continued)

*Primary Examiner* — Alexander Niconovich
(74) *Attorney, Agent, or Firm* — Donald J. Ersler

(57) ABSTRACT

A shooting crossbow includes two cams, two pulleys, a bow string, two cables, a string latch housing, a bow riser, a mainframe barrel and two limbs. The bow riser is enjoined with the barrel. The first and second limbs extend from the bow riser. First and second cams are pivotally retained on first and second limbs. The first and second cams retain a bowstring. The cams and pulleys retain first and second cables. The two pulleys are retained on the barrel. The mainframe barrel combines elements of an AR style butt stock mounting tube, and flight deck elements of a crossbow barrel extrusion.

18 Claims, 10 Drawing Sheets

(56) References Cited

U.S. PATENT DOCUMENTS 8,931,465 B1 * 1/2015 Choma ..... F41B 5/12 124/25
8,950,385 B1 * 2/2015 Khoshnood ..... F41B 5/1469 124/1
8,955,245 B2 * 2/2015 Chvala ..... F41C 23/14 42/1.06
8,978,634 B2 * 3/2015 Darlington ..... F41B 5/12 124/25
8,991,375 B2 * 3/2015 McPherson ..... F41B 5/123 124/24.1
9,146,071 B2 * 9/2015 Liu ..... F41B 5/1403
2002/0050088 A1 * 5/2002 Sharp ..... F41C 23/14 42/73
2006/0169259 A1 * 8/2006 Chang ..... F41B 5/1426 124/25
2008/0168969 A1 * 7/2008 Kempf ..... F41B 5/1469 124/25
2008/0251058 A1 * 10/2008 Colley ..... F41B 5/105 124/25
2009/0101126 A1 * 4/2009 Anderson ..... F41B 5/123 124/25
2010/0170488 A1 * 7/2010 Rasor et al. ..... F41A 11/02 124/25
2010/0170489 A1 * 7/2010 Shepley et al. ..... F41B 5/12 124/25
2011/0030666 A1 * 2/2011 Darlington ..... F41B 5/123 124/25
2011/0056467 A1 * 3/2011 Popov et al. ..... F41B 5/0094 124/25.6
2012/0006311 A1 * 1/2012 Bednar et al. ..... F41B 5/123 124/25
2012/0199106 A1 * 8/2012 Bednar et al. ..... F41B 5/12 124/25
2012/0298087 A1 * 11/2012 Trpkovski ..... F41B 5/10 124/25
2012/0304974 A1 * 12/2012 Goff et al. ..... F41B 5/123 124/25
2013/0213371 A1 * 8/2013 Biafore, Jr. ..... F41B 5/12 124/25
2013/0213372 A1 * 8/2013 Biafore, Jr. et al. ..... F41B 5/123 124/25
2013/0213373 A1 * 8/2013 Biafore, Jr. et al. ..... F41B 5/12 124/25
2014/0261358 A1 * 9/2014 Pulkrabek et al. ..... F41B 5/105 124/25.6
2014/0261360 A1 * 9/2014 Pulkrabek et al. .... F41B 5/1469 124/35.2

* cited by examiner

ASSAULT RIFLE STYLE MAINFRAME BARREL FOR A CROSSBOW

BACKGROUND OF THE INVENTION

1. Field of the Invention

The present invention relates generally to archery and more specifically to an assault rifle style mainframe barrel for a crossbow, which is directly received by a butt stock of an assault rifle.

2. Discussion of the Prior Art

Historically, archery bows and crossbows have been used for war, survival, sport, and recreation. A specific component of a shooting crossbow is the barrel. Various methods are known in the production of crossbow barrels, such as hollow extrusions, machined billet, injection molding and the like. While all of these methods work to some extent, all have significant issues with performance and/or assembly and cost.

U.S. Pat. No. 7,810,480 to Shepley discloses a crossbow wherein the upper and lower receiver of an assault rifle (AR) are coupled to a crossbow barrel and bow assembly. The AR style butt stock is slideably coupled to a tube, and the tube is then coupled to the receiver. The crossbow barrel is a separate piece, and it is coupled to the lower receiver. With this design, it takes multiple pieces and extensive tooling to achieve the desired design. U.S. Pat. No. 8,651,094 to Matasic discloses a crossbow with an AR style butt stock. Again, the AR style butt stock is slideably coupled to a tube, and the tube is then coupled to the rear of a string latch housing. The crossbow barrel is a separate piece, and it is coupled to the front of the string latch housing. With both of these designs, the tube that slideably couples the AR style butt stock and the crossbow barrel are on separate planes and parallel to each other. Though functional, these are complex and costly designs.

Accordingly, there is a clearly felt need in the art to provide an assault rifle style mainframe barrel for a crossbow, which is directly received by a butt stock of an assault rifle without the necessity of a costly adapter device.

SUMMARY OF THE INVENTION

The present invention provides an assault rifle style mainframe barrel for a crossbow (mainframe barrel), which includes a cross section that is directly received by a butt stock of an assault rifle and also retains other parts of the crossbow. The mainframe barrel preferably extends at least three inches behind a string latch housing and fourteen inches in front of the string latch housing. The mainframe barrel combines elements of an AR style butt stock mounting tube and flight deck rail elements of a crossbow barrel extrusion. However, the mainframe barrel may also be fabricated by plastic injection molding.

Accordingly, there is a clearly felt need in the art for an mainframe barrel, which is directly received by a butt stock of an assault rifle without the necessity of a costly adapter device.

These and additional objects, advantages, features and benefits of the present invention will become apparent from the following specification.

DETAILED DESCRIPTION OF THE PREFERRED EMBODIMENTS

Figure 1:
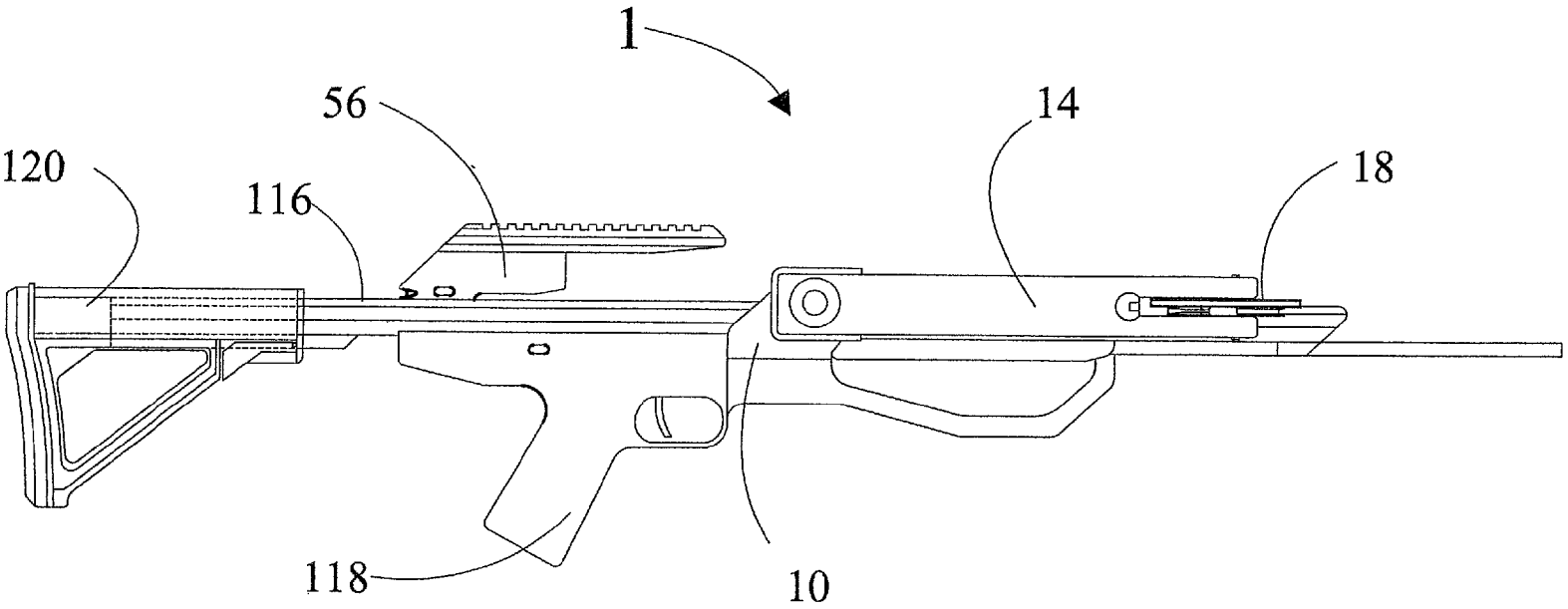
FIG. 1 is a side view of a reverse limb crossbow having a mainframe barrel, an AR style butt stock, a string latch housing, and a bow assembly in accordance with the present invention.
Figure 1A:
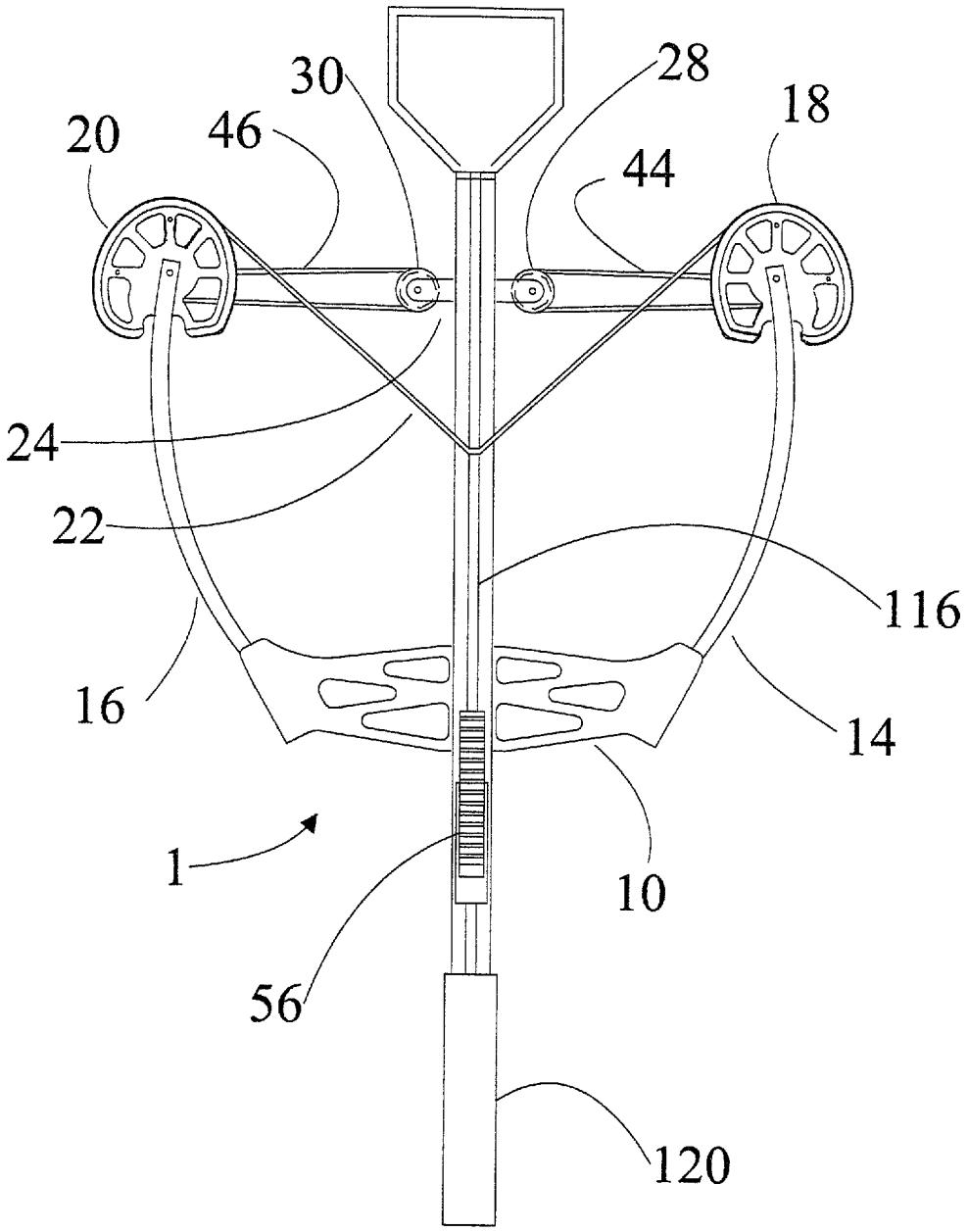
FIG. 1*a* is a top view of a reverse limb crossbow having a mainframe barrel, an AR style butt stock, a string latch housing, and a bow assembly in accordance with the present invention.
Figure 2:
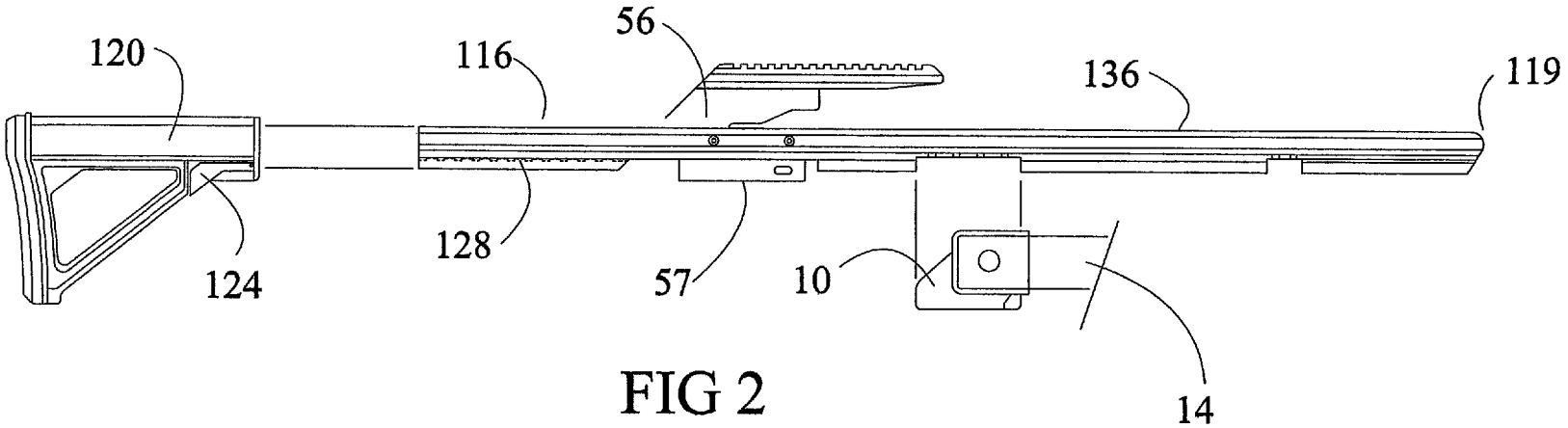
FIG. 2 is a partially exploded view showing of a reverse limb crossbow having an AR style butt stock, a mainframe barrel, a detached riser and a string latch housing in accordance with the present invention.
Figure 9:
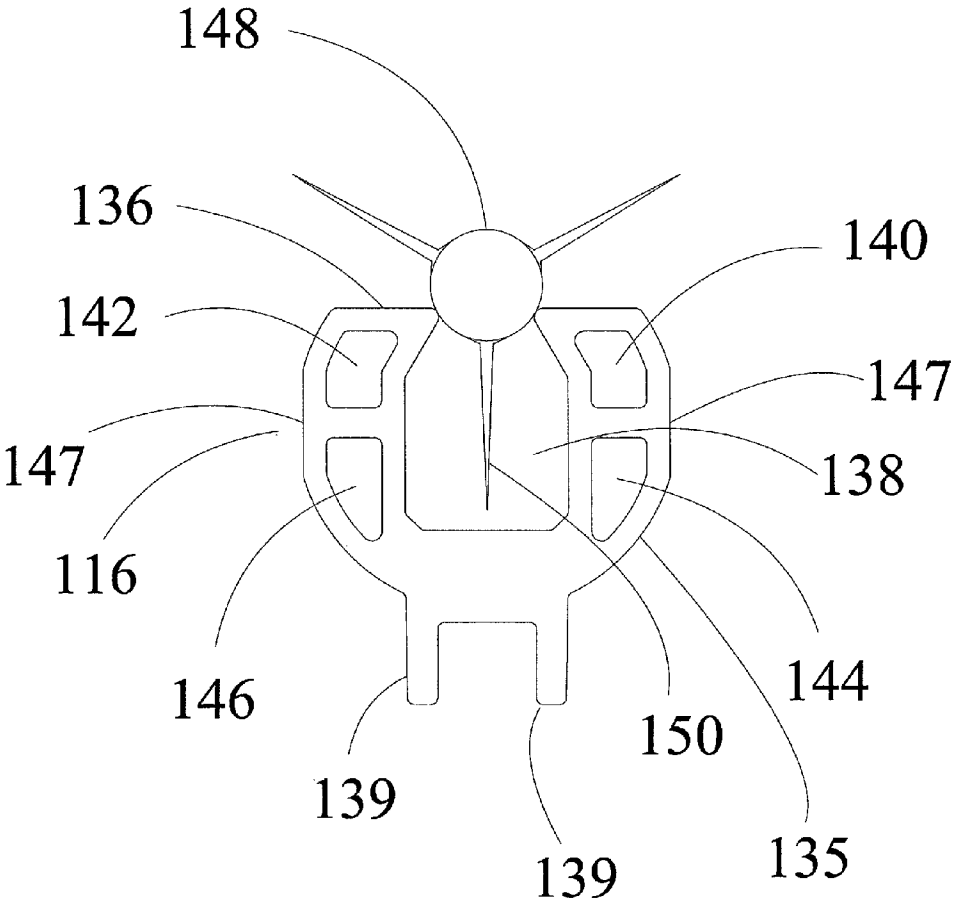
FIG. 9 is an end view of a mainframe barrel for a reverse limb crossbow in accordance with the present invention.

With reference now to the drawings, and particularly to FIG. 1, there is shown a side view of a reverse limb crossbow with an AR style pistol grip and butt stock (reverse limb crossbow) 1. With reference to FIGS. 1A & 2, the reverse limb crossbow 1 includes a riser 10, two limbs 14, 16, two cams 18, 20, a bow string 22, a string latch housing 56, a mainframe barrel 116, a pistol grip 118 and an AR style butt stock 120. With reference to FIG. 9, the mainframe barrel 116 includes a first end 117, a second end 119 and an elongated length. The mainframe barrel 116 preferably includes a partially round outer surface 135, a flight deck 136, an arrow vane channel 138, a pair of guide rails 139 and multiple chambers 140, 142, 144, 146. The flight deck 136 is substantially horizontal and is formed in a top of the mainframe barrel 116. The pair of guide rails 139 extend from a bottom of the mainframe barrel 116. The pair of guide rails 139 extend at least a portion of the elongated length, starting at the first end 117. The multiple chambers 140, 142, 144, 146 run at least partially a length of the mainframe barrel 116. The chambers 142 and 146 are formed on one side of said arrow vane chamber 138 and the chambers 140 and 144 are formed on an opposing side of said arrow vane chamber 138.

Figure 5:
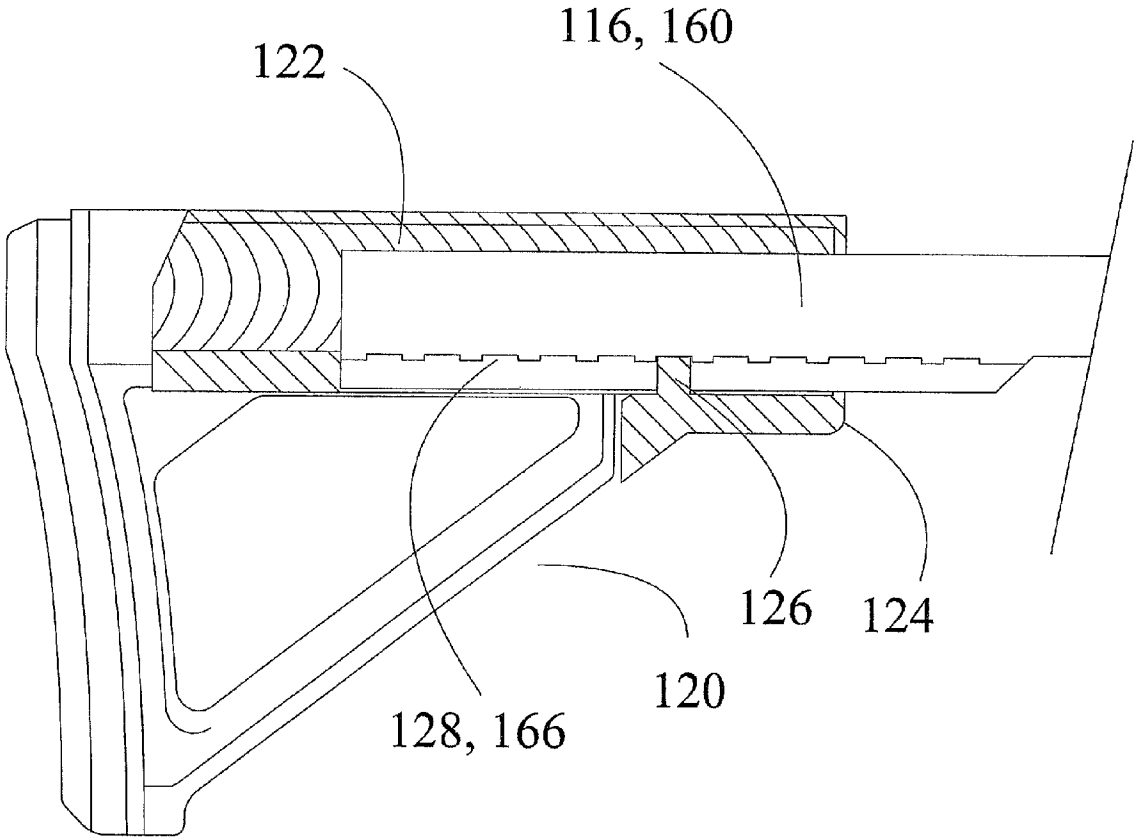
FIG. 5 is a partial cut away side view of an AR style butt stock with a rear of a mainframe barrel engaged inside thereof in accordance with the present invention.

A pair of opposing flats 147 are preferably formed in opposing sides of the partially round outer surface 135. FIG. 2 shows a partially exploded view of the reverse limb crossbow 1 with the riser 10 detached from the mainframe barrel 116. With reference to FIG. 5, the AR style butt stock 120 includes a tube cavity 122 and a locking mechanism 124. The tube cavity 122 is sized to be slidably received by the mainframe barrel 116. The locking mechanism 124 is located on a bottom of the tube cavity 122. A locking pin 126 extends upward from the locking mechanism into tube cavity 122. A plurality of pin cavities 128 are formed in a bottom of the mainframe barrel 116 at a first end 117 to receive the locking pin 126. The locking mechanism 124 is retracted to allow the first end 117 of the mainframe barrel 116 to be inserted into the tube cavity 122 of the AR style butt stock 120 and locked into place with the locking pin 126 of the locking mechanism.

The pistol grip 118 is attached to a lower portion 57 of the string latch housing 56 and a bottom of the mainframe barrel 116.

Figure 3:
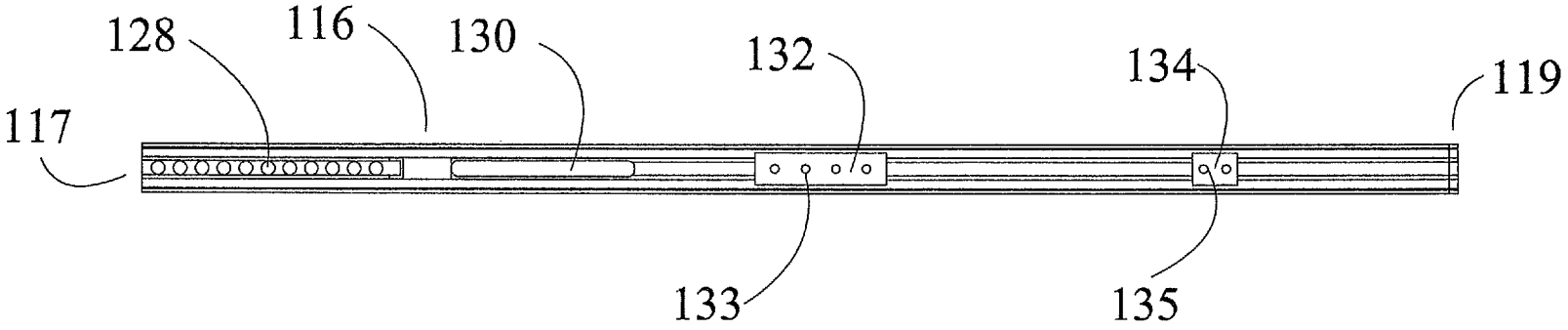
FIG. 3 is a bottom view of a mainframe barrel for a reverse limb crossbow with an AR style butt stock in accordance with the present invention.
Figure 4:
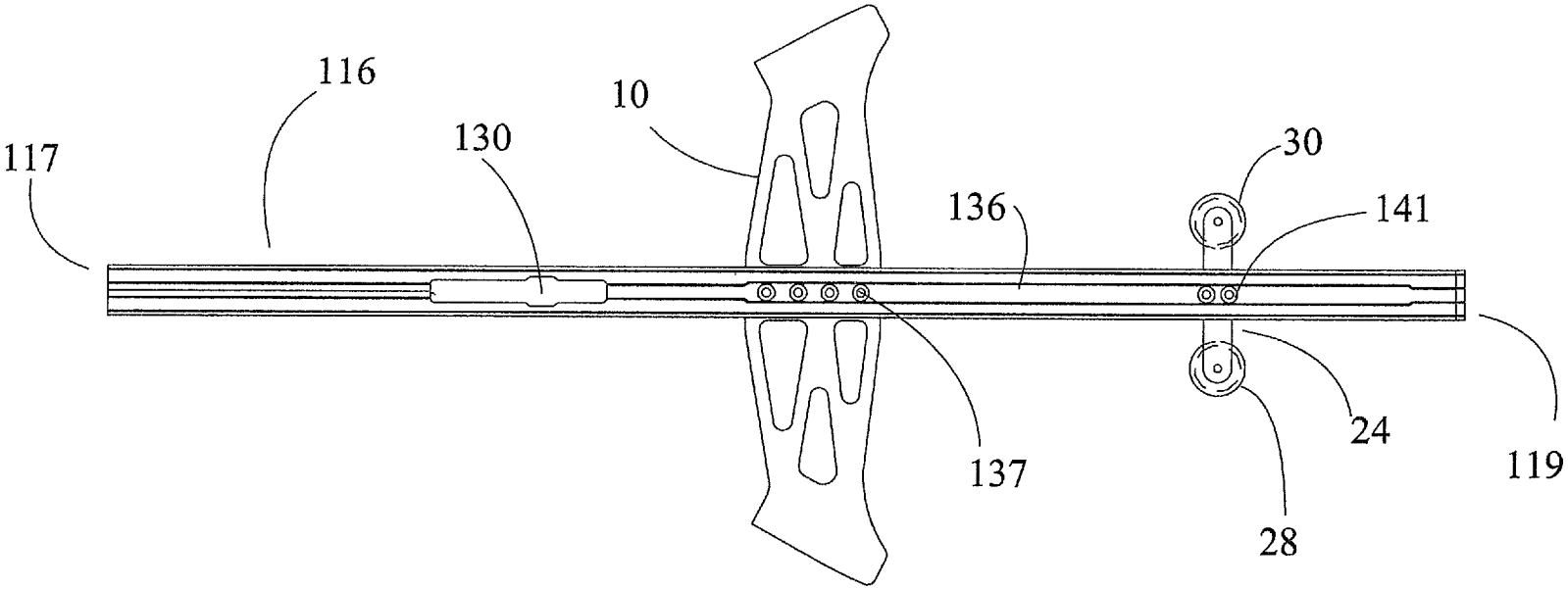
FIG. 4 is a top view of a mainframe barrel for a reverse limb crossbow with an AR style butt stock with a riser and cable hub attached thereto in accordance with the present invention.

With reference to FIGS. 3-4, the mainframe barrel 116 is a machined extrusion for the preferable attachment of the riser 10, a cable hub 24, the string latch housing 56 and the butt stock 120. However, the mainframe barrel 116 may also be fabricated by plastic injection molding. The cable hub 24 includes a pair of opposing cable pulleys 28, 30, which retain cables 44, 46. A latch housing slot 130 is formed through the mainframe barrel 116 to receive the string latch housing 56. A riser flat surface 132 is machined in a bottom of the mainframe barrel 116 at substantially a middle thereof to receive the riser 10. A plurality of openings 133 are formed through the mainframe barrel 116, for attaching the riser 10 to the mainframe barrel 116 with a plurality of fasteners 137. A hub flat surface 134 is machined in a bottom and of the mainframe barrel 116 at substantially a second end 119 thereof to receive the cable hub 24. A pair of openings 135 are formed through the mainframe barrel 116 to attach the cable hub 24 with a pair of fasteners 141.

Figure 6:
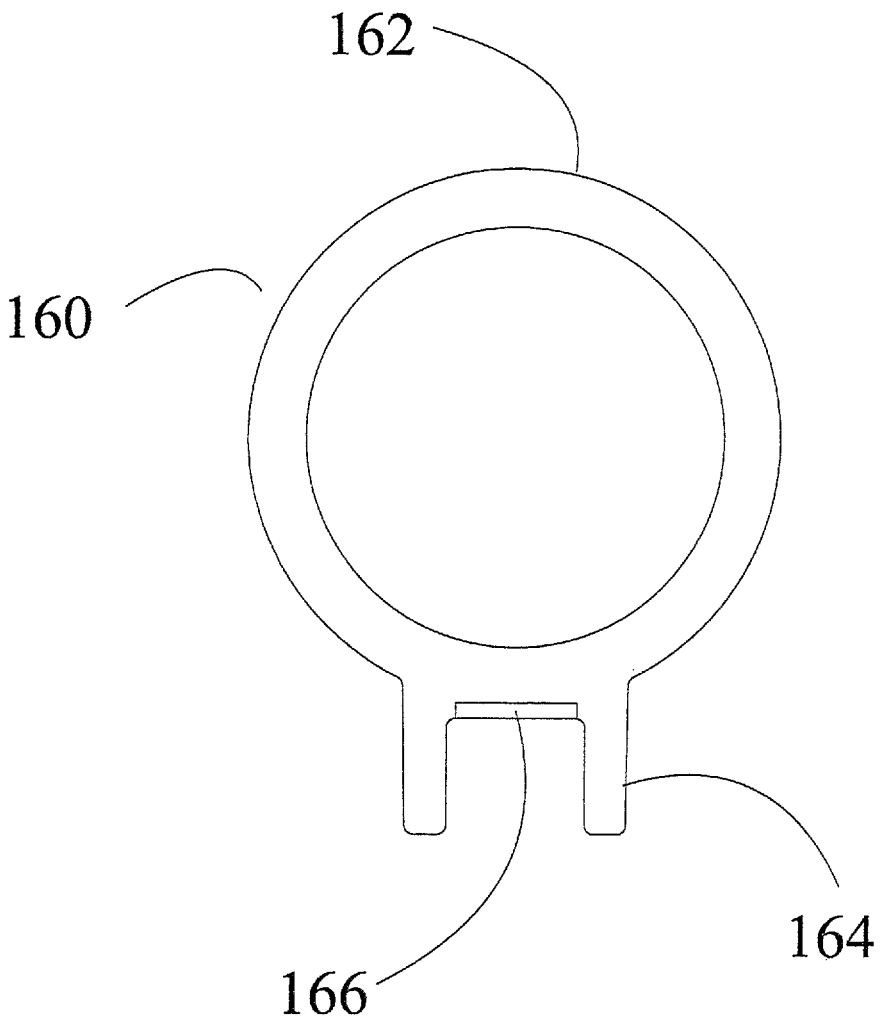
FIG. 6 is an end view of an AR style butt stock mounting tube.
Figure 7:
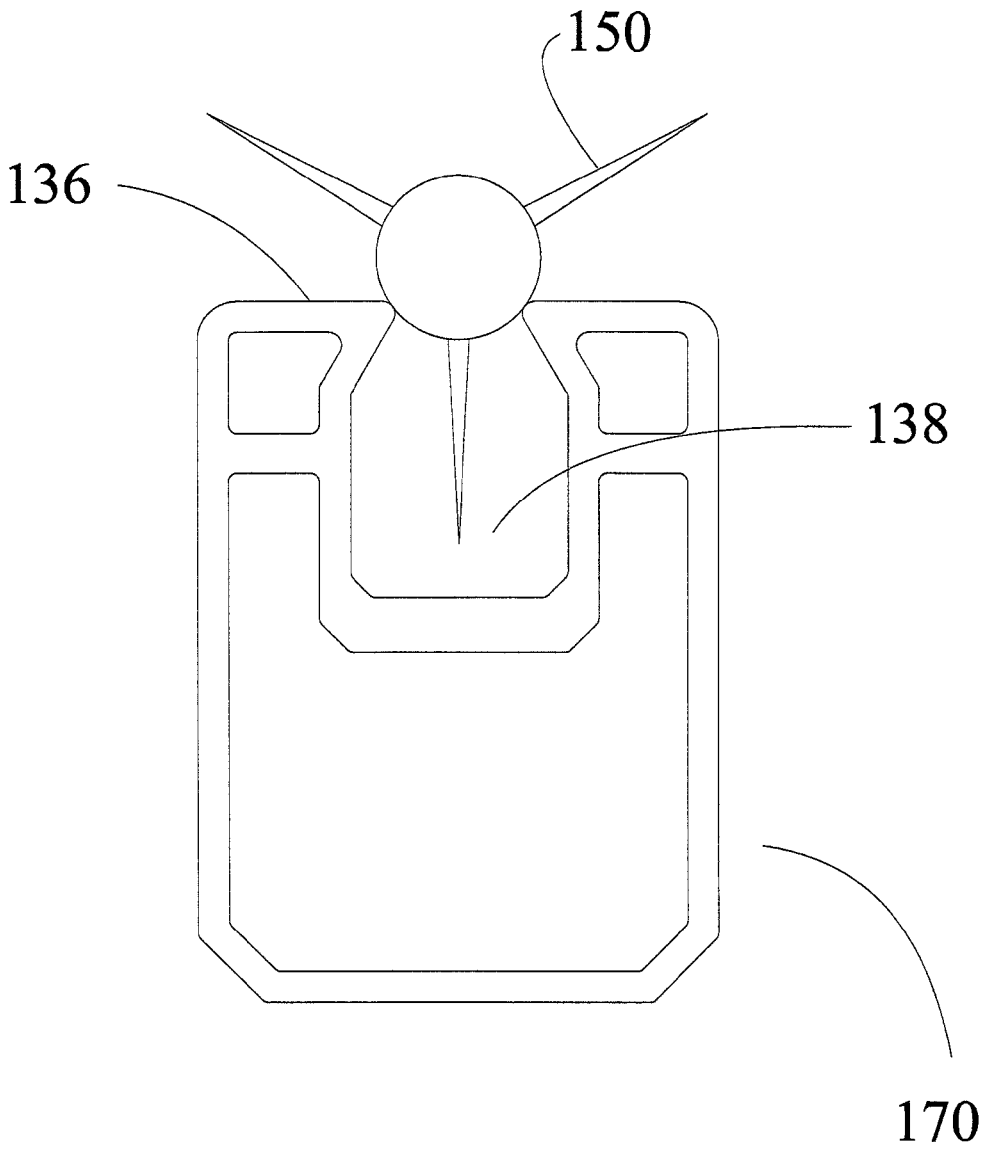
FIG 7 (PRIOR ART)
FIG. 7 is an end view of a typical extruded crossbow barrel.
Figure 8:
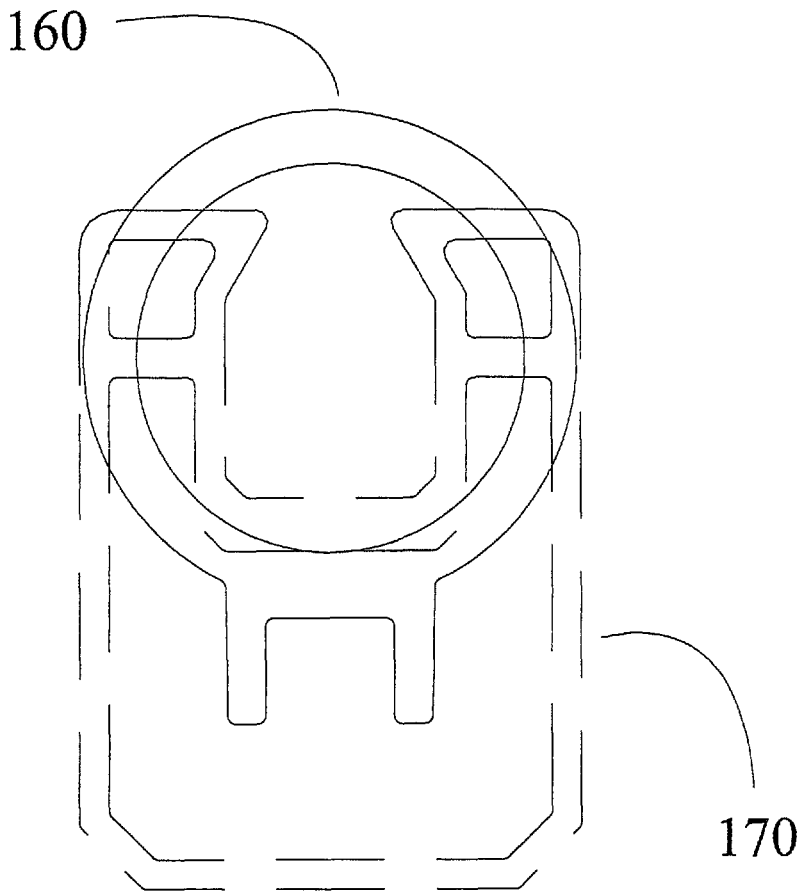
FIG. 8 is an end view of an AR style mounting tube, superimposed over a cross sectional view of an extruded crossbow barrel.

FIG. 5 illustrates a partial cutaway view of a typical AR style butt stock 120. FIG. 6 shows a cross sectional view of an AR style mounting tube 160. The AR style mounting tube 160 includes function elements of an elongated body 162, a pair of guide rails 164 and a plurality of indexing stop pockets 166. When the AR style butt stock 120 is slideably engaged with the mainframe barrel 116 or the AR style mounting tube 160, and the butt stock lock mechanism 124 is engaged, the locking pin 126 engages the indexing stop pockets 128 of the mainframe barrel 116 or the indexing stop pockets 166 of the AR style mounting tube 160. With reference to FIG. 7, key functional elements of a typical crossbow barrel 170 include a flight deck 136 and an arrow vane channel 138. The arrow 148 typically rests in a center of the flight deck 136, and one of the arrow vanes 150 extends downwards into the arrow vane channel 138. With reference to FIG. 8, a cross section of the mounting tube 160 with solid lines is overlaid on a typical cross bow barrel 170 in dashed lines. The mainframe barrel 116 combines the functional elements of the AR style mounting tube 160 with the functional elements of a typical crossbow barrel 170.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A cross bow barrel adapted to be received by an assault rifle style butt stock, comprising:

a barrel having a first distal end, a second opposite distal end and an elongated length extending from said first distal end to said second opposite distal end;

a cross section of said barrel includes a partially round outer surface, a substantially horizontal flight deck is formed on a top of said barrel, an arrow vane channel is formed through said substantially horizontal flight deck into said barrel; and a pair of guide rails extend from a bottom of said barrel, each one of said pair of guide rails includes two opposing exterior side surfaces, said pair of guide rails extend at least a portion of said elongated length, starting at said first distal end of said barrel, wherein said first distal end of said barrel is retained in a tube cavity of a butt stock of an assault rifle, a central lengthwise axis of the tube cavity of the butt stock is located on a lengthwise axis of said barrel; and wherein the cross section of the barrel is constant along substantially the entire elongated length.

2. The cross bow barrel adapted to be received by an assault rifle style butt stock of claim 1, wherein:

a riser flat surface is machined in the bottom of said barrel at substantially a middle of said elongated length to receive a riser.

3. The cross bow barrel adapted to be received by an assault rifle style butt stock of claim 1, wherein:

a plurality of pin cavities are formed in the bottom of said barrel at said first distal end to receive a locking pin of the assault rifle butt stock.

4. The cross bow barrel adapted to be received by an assault rifle style butt stock of claim 1, wherein:

a latch housing slot is formed through said barrel to receive a string latch housing.

5. The cross bow barrel adapted to be received by an assault rifle style butt stock of claim 1, further comprising:

a pistol grip is attached to the bottom of said barrel.

6. The cross bow barrel adapted to be received by an assault rifle style butt stock of claim 1, wherein:

a hub flat surface is formed in the bottom of said barrel at substantially said second distal end to receive a cable hub, the cable hub includes a pair of opposed pulleys.

7. A cross bow barrel adapted to be received by an assault rifle style butt stock, comprising:

a barrel having a first distal end, a second opposite distal end and an elongated length extending from said first distal end to said second opposite distal end;

a cross section of said barrel includes a partially round outer surface, a substantially horizontal flight deck is formed on a top of said barrel, an arrow vane channel is formed through said substantially horizontal flight deck into said barrel, at least one first chamber is formed on a first side of said arrow vane chamber, at least one second chamber is formed on a second side of said arrow vane chamber; and a pair of guide rails extend from a bottom of said barrel, each one of said pair of guide rails includes two opposing exterior side surfaces, said pair of guide rails extend at least a portion of said elongated length, starting at said first distal end of said barrel, wherein said first distal end of said barrel is retained in a tube cavity of a butt stock of an assault rifle, a central lengthwise axis of the tube cavity of the butt stock is located on a lengthwise axis of said barrel; and wherein the cross section of the barrel is constant along substantially the entire elongated length.

8. The cross bow barrel adapted to be received by an assault rifle style butt stock of claim 7, wherein:

two first chambers are formed on said first side of said arrow vane chamber, two second chambers are formed on said second side of said arrow vane chamber.

9. The cross bow barrel adapted to be received by an assault rifle style butt stock of claim 7, wherein:

a riser flat surface is machined in the bottom of said barrel at substantially a middle of said elongated length to receive a riser.

10. The cross bow barrel adapted to be received by an assault rifle style butt stock of claim 7, wherein:

a plurality of pin cavities are formed in the bottom of said barrel at said first distal end to receive a locking pin of the assault rifle butt stock.

11. The cross bow barrel adapted to be received by an assault rifle style butt stock of claim 7, wherein:

a latch housing slot is formed through said barrel to receive a string latch housing.

12. The cross bow barrel adapted to be received by an assault rifle style butt stock of claim 7, further comprising:

a pistol grip is attached to the bottom of said barrel.

13. The cross bow barrel adapted to be received by an assault rifle style butt stock of claim 7, wherein:

a hub flat surface is formed in the bottom of said barrel at substantially said second distal end to receive a cable hub, the cable hub includes a pair of opposed pulleys.

14. A cross bow barrel adapted to be received by an assault rifle style butt stock, comprising:

a barrel having a first distal end, a second opposite distal end and an elongated length extending from said first distal end to said second opposite distal end;

a cross section of said barrel includes a partially round outer surface, a substantially horizontal flight deck is formed on a top of said barrel, an arrow vane channel is formed through said substantially horizontal flight deck into said barrel;

a pair of guide rails extend from a bottom of said barrel, each one of said pair of guide rails includes two opposing exterior side surfaces, said pair of guide rails extend at least a portion of said elongated length, starting at said first distal end of said barrel, wherein said first distal end of said barrel is retained in a tube cavity of a butt stock of an assault rifle, a central lengthwise axis of the tube cavity of the butt stock is located on a lengthwise axis of said barrel; and a riser flat surface is machined in the bottom of said barrel at substantially a middle thereof to receive a riser; and wherein the cross section of the barrel is constant along substantially the entire elongated length.

15. The cross bow barrel adapted to be received by an assault rifle style butt stock of claim 14, further comprising:

a plurality bolts are used to attach the riser to said barrel.

16. The cross bow barrel adapted to be received by an assault rifle style butt stock of claim 14, wherein:

a plurality of pin cavities are formed in the bottom of said barrel at said first distal end to receive a locking pin of the assault rifle butt stock.

17. The cross bow barrel adapted to be received by an assault rifle style butt stock of claim 14, wherein:

a latch housing slot is formed through said barrel to receive a string latch housing.

18. The cross bow barrel adapted to be received by an assault rifle style butt stock of claim 14, wherein:

a hub flat surface is formed in the bottom of said barrel at substantially said second distal end receive a cable hub, the cable hub includes a pair of opposed pulleys.

* * * * *